US011447850B2

(12) United States Patent
Li et al.

(10) Patent No.: US 11,447,850 B2
(45) Date of Patent: Sep. 20, 2022

(54) WEAR-RESISTANT COMPONENT AND SYSTEM

(71) Applicant: GM Global Technology Operations LLC, Detroit, MI (US)

(72) Inventors: Zhe Li, Rochester, MI (US); Wenying Yang, Rochester Hills, MI (US); Qigui Wang, Rochester Hills, MI (US); Dale A. Gerard, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 617 days.

(21) Appl. No.: 16/394,394

(22) Filed: Apr. 25, 2019

(65) Prior Publication Data

US 2020/0340090 A1 Oct. 29, 2020

(51) Int. Cl.

| | |
|---|---|
| ***C22F 1/04*** | (2006.01) |
| ***C23C 4/10*** | (2016.01) |
| ***B22D 19/00*** | (2006.01) |
| ***B22D 17/00*** | (2006.01) |
| ***C22C 21/00*** | (2006.01) |

(52) U.S. Cl.

CPC ..... *C22F 1/04* (2013.01); *B22D 17/00* (2013.01); *B22D 19/00* (2013.01); *C22C 21/00* (2013.01); *C23C 4/10* (2013.01)

(58) Field of Classification Search

CPC . C22C 21/00; C22C 21/02; C22F 1/04; C22F 1/043

See application file for complete search history.

(56) References Cited

FOREIGN PATENT DOCUMENTS

JP 10152731 A * 6/1998

OTHER PUBLICATIONS

Adachi, Mitsuru, JP-10152731-A machine translation, 1998 (Year: 1998).*

* cited by examiner

*Primary Examiner* — Nicholas A Wang
*Assistant Examiner* — Maxwell Xavier Duffy
(74) *Attorney, Agent, or Firm* — Quinn IP Law

(57) ABSTRACT

A wear-resistant component includes a substrate formed from a metal, defining a bore, and having a bore surface. The substrate includes a first region having a first microstructure adjacent the bore surface and a first average particle size. The substrate also includes a second region having a second microstructure adjacent the first microstructure and a second average particle size. The first average particle size is larger than the second average particle size. A system and a method of forming the wear-resistant coating are also described.

17 Claims, 4 Drawing Sheets

WEAR-RESISTANT COMPONENT AND SYSTEM

INTRODUCTION

The disclosure relates to a wear-resistant component and system and to a method of forming the wear-resistant component.

Devices, such as vehicles, manufacturing equipment, and the like, often include components that require wear-resistance under specific operating conditions. For example, transmission cases and clutch housings may include elements which rotate or move relative to one another under boundary or mix lubrication conditions. Such relative movement may induce wear on one or more surfaces of the components and may over time contribute to operating inefficiencies.

SUMMARY

A wear-resistant component includes a substrate formed from a metal, defining a bore, and having a bore surface. The substrate includes a first region having a first microstructure adjacent the bore surface and a first average particle size. The substrate also includes a second region having a second microstructure adjacent the first microstructure and a second average particle size. The first average particle size is larger than the second average particle size.

In one aspect, the first region may have a first wear-resistance and the second region may have a second wear-resistance that is lower than the first wear-resistance.

In another aspect, the first microstructure may be characterized as coarse and may have a first number of grain boundaries. The second microstructure may be characterized as fine and may have a second number of grain boundaries that is greater than the first number of grain boundaries.

In an additional aspect, the first microstructure may have a dendritic arm spacing of greater than 40 μm and less than or equal to 100 μm. The first microstructure may have a second phase particle size of greater than 5 μm. Further, the second microstructure may have a dendritic arm spacing of from 15 μm to 25 μm.

A system includes a wear-resistant component and a die defining a cavity. The wear-resistant component includes a substrate disposed within the cavity, formed from a metal, defining a bore, and having a bore surface. The substrate includes a first region having a first microstructure adjacent the bore surface and a first average particle size. The substrate also includes a second region having a second microstructure adjacent the first microstructure and a second average particle size. The first average particle size is larger than the second average particle size. The system also includes a core insert disposed within the bore.

In one aspect, the core insert may have an interface surface facing the bore surface and the system may further include a ceramic coating disposed on the interface surface.

In a further aspect, the core insert may be formed from at least one of a salt, sand, and an inorganic binder.

In another aspect, the core insert may have an interface surface facing the bore surface and may include a heating element disposed beneath the interface surface.

A method of forming a wear-resistant component includes disposing a molten metal into a cavity defined by a die at a pressure of from 10 MPa to 175 MPa. The method also includes placing a core insert into the cavity to form a bore surface at an interface of the molten metal and the core insert. Further, the method includes solidifying the molten metal around the core insert, and concurrent to solidifying, cooling the molten metal at the bore surface at a rate of from 0.01° C. per second to 1.5° C. per second to thereby form a substrate. The substrate has a first region having a first microstructure adjacent the bore surface and a first average particle size. The substrate also has a second region having a second microstructure adjacent the first microstructure and a second average particle size. The first average particle size is larger than the second average particle size. The method also includes, after cooling, removing the core insert from the substrate to define a bore and thereby form the wear-resistant component.

In one aspect, cooling may include slowing a local solidification rate of the molten metal within the first region.

In another aspect, cooling may include forming the first region such that the first microstructure is characterized as coarse and includes a first number of grain boundaries.

In a further aspect, the core insert may have an interface surface facing the bore surface, and cooling may include forming the second region such that the second microstructure is characterized as fine and includes a second number of grain boundaries that is greater than the first number of grain boundaries.

In an additional aspect, the method may further include, prior to placing, thermally spraying a ceramic coating onto the core insert.

In yet another aspect, placing the core insert may include injecting a semi-solid paste formed from at least one of a salt, sand, and an inorganic binder into the cavity.

In yet a further aspect, the core insert may have an interface surface facing the bore surface and may include a heating element disposed beneath the interface surface. The method may further include, concurrent to solidifying, warming the core insert at the heating element.

In yet an additional aspect, the method may include, concurrent to solidifying, at least one of induction heating, laser heating, and infrared heating the core insert on the interface surface.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
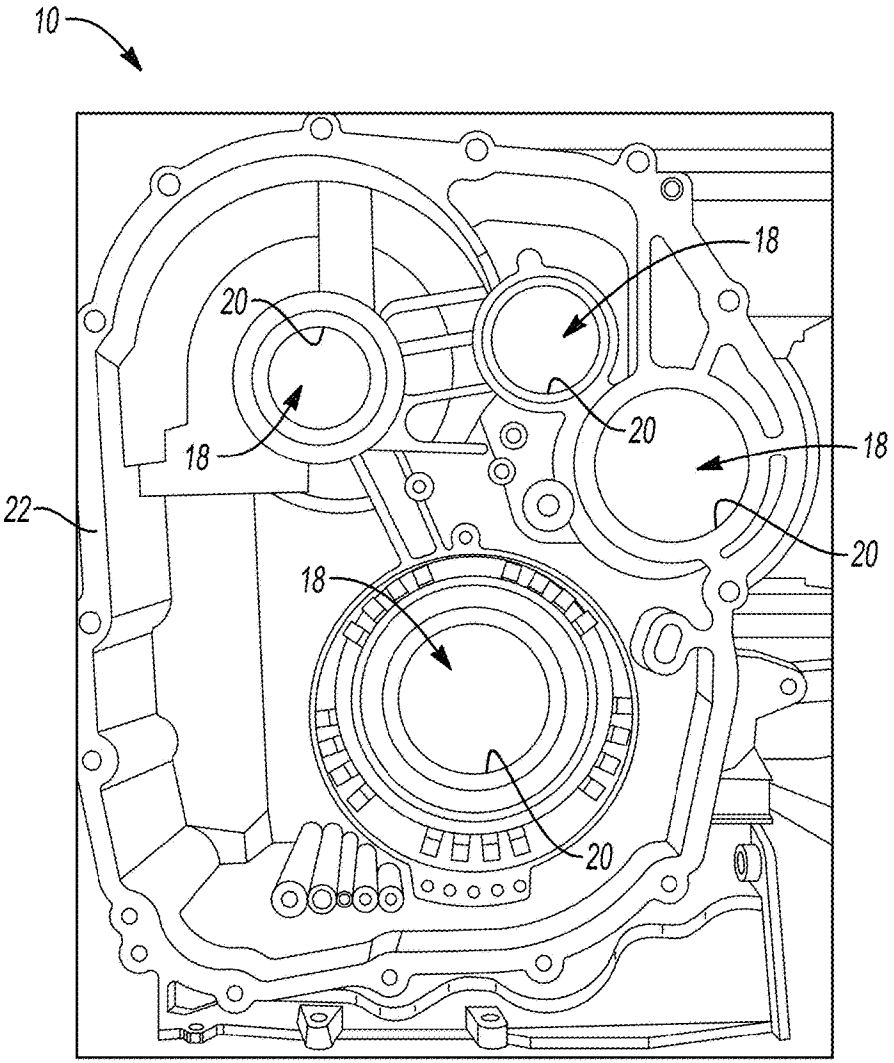
FIG. 1 is a schematic illustration of a perspective view of a wear-resistant component.

Referring to the Figures, wherein like reference numerals refer to like elements, a wear-resistant component 10 is shown generally in FIG. 1. In addition, a system 12 including the wear-resistant component 10 is shown generally in FIG. 2, and a method 14 of forming the wear-resistant component 10 is shown generally in FIG. 8. The wear-resistant component 10, system 12, and method 14 may be useful for applications requiring excellent wear-resistance at a localized region (e.g., a first region 16 shown generally in FIG. 2). For example, as set forth in more detail below, the first region 16 may be located adjacent a bore 18 (FIG. 1) and may provide excellent resistance to wear induced by relative motion between components under boundary, mix, and hydrodynamic lubrication conditions at typical lubricant running temperatures, e.g., less than about 200° C. As such, the wear-resistant component 10, system 12, and method 14 may be useful for automotive applications such as transmission cases and clutch housings for passenger cars and trucks. However, the wear-resistant component 10, system 12, and method 14 may alternatively be useful for non-automotive applications such as, but not limited to, generators, turbines, and equipment that includes one or more rotating shafts, and other vehicle types such as, but not limited to, industrial vehicles, recreational off-road vehicles, motorcycles, aircraft, ships, and the like.

As used herein, the terminology wear-resistant refers to a tribological property of the component 10 and describes a capability of the component 10 to avoid damage and maintain functionality under relative motion when in contact with other components made from various, diverse materials including, but not limited to, metal, plastic, ceramic, and the like, under boundary, mix, and hydrodynamic lubrication running conditions and typical lubricant operating conditions. That is, the wear-resistant component 10 may not be easily damaged by a counter surface, and may not result in gradual shape loss or material loss at a contact interface under typical operating or running conditions and environments (e.g., at a bore surface 20 shown generally in FIG. 2).

Referring again to FIG. 1, the wear-resistant component 10 includes a substrate 22 formed from a metal, defining the bore 18, and having a bore surface 20. That is, the substrate 22 may define one or more bores 18 therethrough and the bore surface 20 may be configured for contacting a rotatable shaft (not shown) without experiencing excessive degradation or deformation or wear, as set forth in more detail below. In one embodiment, the metal may be aluminum or an aluminum alloy such as, but not limited to, A380, A383, A360, ZA-8, ZA-12, and ZA-27. The metal may be selected according to a desired level of strength, corrosion-resistance, temperature-resistance, dimensional stability, electrical and/or thermal conductivity, and the like.

Figure 4A:
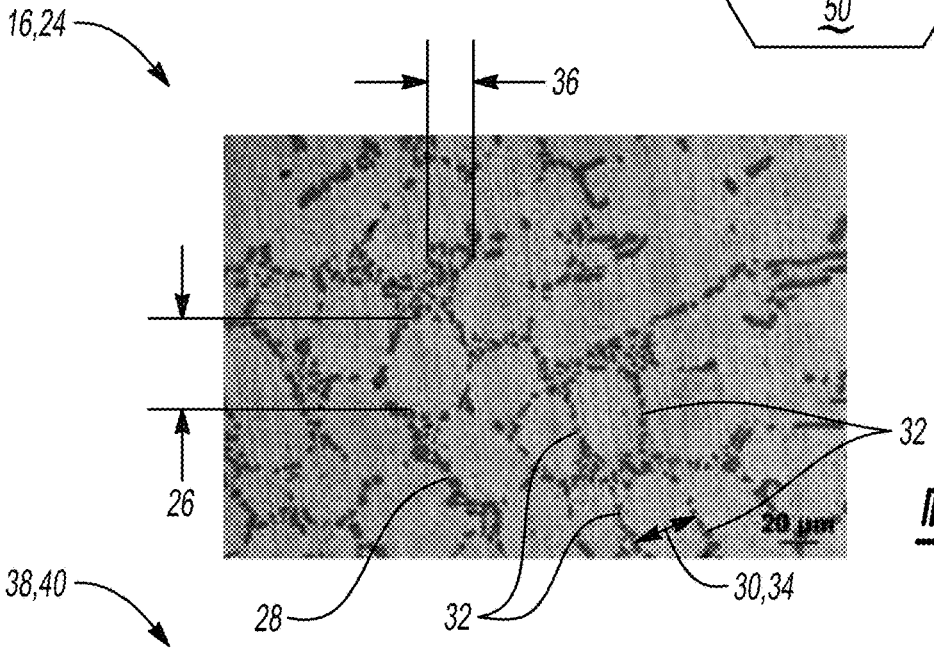
FIG. 4A is a schematic illustration of a magnified view of a first region of the wear-resistant component of FIG. 1.

As described with reference to FIG. 2, the substrate 22 also includes the first region 16 having a first microstructure 24 (FIG. 4A) adjacent the bore surface 20 and a first average particle size 26 (FIG. 4A). As used herein, the terminology microstructure is used to describe an appearance of the substrate 22 on the nanometer-to-centimeter length scale. That is, the microstructure may be observed using microscopy. The terminology microstructure is contrasted with a crystal structure of the substrate 22. The terminology crystal structure is used to describe an average position of atoms within a unit cell of the substrate 22, and is specified by a lattice type and fractional coordinates of the atoms as determined, for example, by X-ray diffraction. In other words, the crystal structure describes the appearance of the substrate 22 on an atomic or Angstrom length scale. Further, the terminology average particle size refers to an average measured dimension (e.g., length, width, radius, aspect ratio, etc.) of solid particles.

The first microstructure 24 may be characterized as coarse and may have a first number of grain boundaries 28. Further, the first microstructure 24 may have a dendritic arm spacing 30 of greater than 40 μm and less than or equal to 100 μm. That is, the first microstructure 24 may have a plurality of dendrite arms 32 defining a plurality of gaps 34 therebetween, and the dendritic arm spacing 30 may measure a size of the gaps 34 between neighboring dendrite arms 32. For example, the first microstructure 24 may have a dendritic arm spacing 30 of from 45 μm to 80 μm, or 60 μm. Such dendritic arm spacing 30 may provide the bore surface 20 (FIG. 2) with excellent wear-resistance.

The first microstructure 24 may also have a second phase particle size 36 of greater than 5 μm. That is, the first microstructure 24 may include a plurality of finely dispersed second phase particles, formed from, for example, silicon, that may be characterized as precipitates within the metal. Such second phase particles may provide the substrate 22 and bore surface 20 with increased strength. For example, the second phase particle size 36 may be greater than 10 μm or greater than 20 μm, but may be less than or equal to 30 μm. Such second phase particle size 36, alone or in combination with the dendritic arm spacing 30 described above, may provide the bore surface 20 with excellent wear-resistance.

Figure 4B:
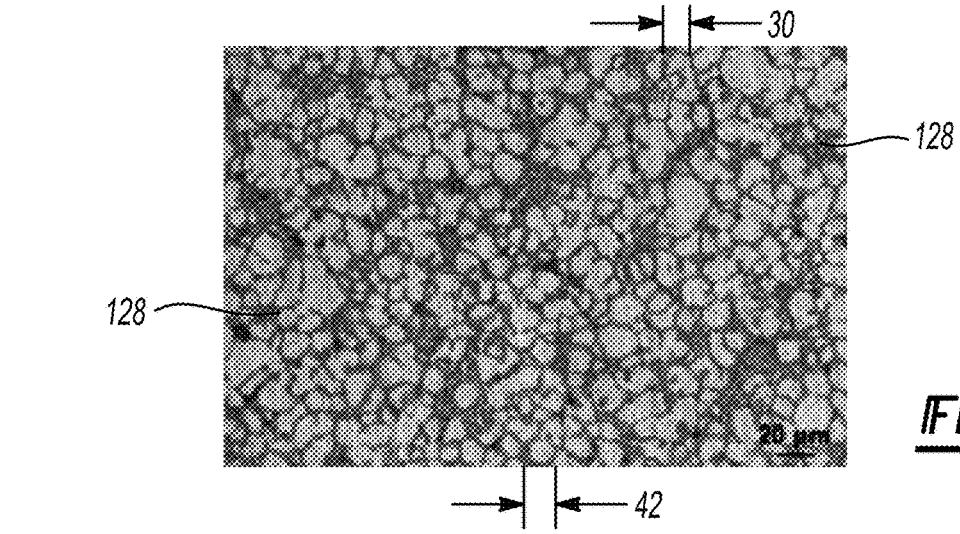
FIG. 4B is a schematic illustration of a magnified view of a second region of the wear-resistant component of FIG. 1.

Referring again to FIG. 2, the substrate 22 also includes a second region 38 having a second microstructure 40 (FIG. 4B) adjacent the first microstructure 24 and a second average particle size 42 (FIG. 4B). That is, the first average particle size 26 is larger than the second average particle size 42 such that the first region 16 has superior wear-resistance. In particular and as set forth in more detail below, as the substrate 22 cools during formation, the first microstructure 24 may transition to the second microstructure 40 at a distance 44 (FIG. 2) from the bore surface 20.

As compared with the first microstructure 24 of FIG. 4A, the second microstructure 40 of FIG. 4B may be characterized as fine and may have a second number of grain boundaries 128 that is greater than the first number of grain boundaries 28. For example, the second microstructure 40 may have twice as many second number of grain boundaries 128 than first number of grain boundaries 28. Further, the second microstructure 40 may have a dendritic arm spacing 30 of from 15 μm to 25 μm. For example, the second microstructure 40 may have a dendritic arm spacing 30 of from 17 μm to 23 μm, or 20 μm. Since the second microstructure 40 has the dendritic arm spacing that is less than the dendritic arm spacing of the first microstructure 24, the second region 38 may have a lesser wear-resistance than the first region 16. Stated differently, the first region 16 may have a first wear-resistance and the second region 38 may have a second wear-resistance that is lower than the first wear-resistance. As such, the first region 16, which is disposed directly adjacent the bore surface 20, may have superior wear-resistance as compared to the second region 38 and may not be subject to frictional losses, degradation, and/or deformation during relative movement between components.

Figure 3:
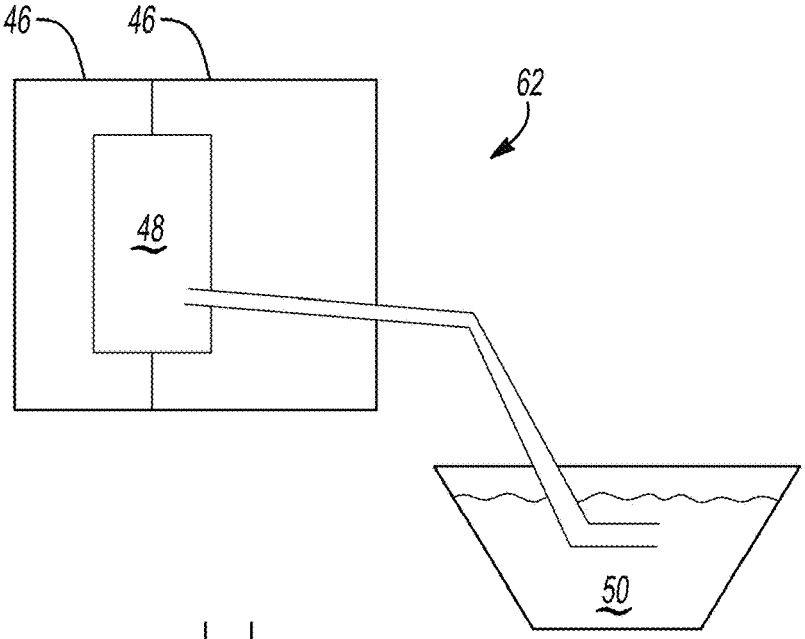
FIG. 3 is a schematic illustration of a cross-sectional side view of the die of FIG. 2.

Referring now to FIG. 3, the system 12 includes a die 46 defining a cavity 48. For example, the system 12 may be configured for die casting the wear-resistant component 10. The die 46 may include two hardened tool steel halves configured for mating to define the cavity 48, and the cavity 48 may receive molten metal 50 under pressure during die casting. As such, as set forth in more detail below, the system 12 also includes the substrate 22 disposed within the cavity 48 during formation of the wear-resistant component 10.

As described with reference to FIGS. 2 and 5-7, the system 12 also includes a core insert 52 disposed within the bore 18. That is, as best shown in FIG. 2, during formation of the wear-resistant component 10, the core insert 52 may preclude the molten metal 50 (FIG. 3) from filling a space to thereby define the bore 18 and form the bore surface 20. For example, the core insert 52 may have a generally cylindrical shape to thereby form a cylindrical bore 18. Alternatively or additionally, the core insert 52 may taper from one end to another for ease of removal from the bore 18. Further, the first region 16 having the first microstructure 24 may be formed adjacent the core insert 52. Then, upon formation of the wear-resistant component 10, the core insert 52 may be removed from the bore 18 as set forth in more detail below.

Figure 5:
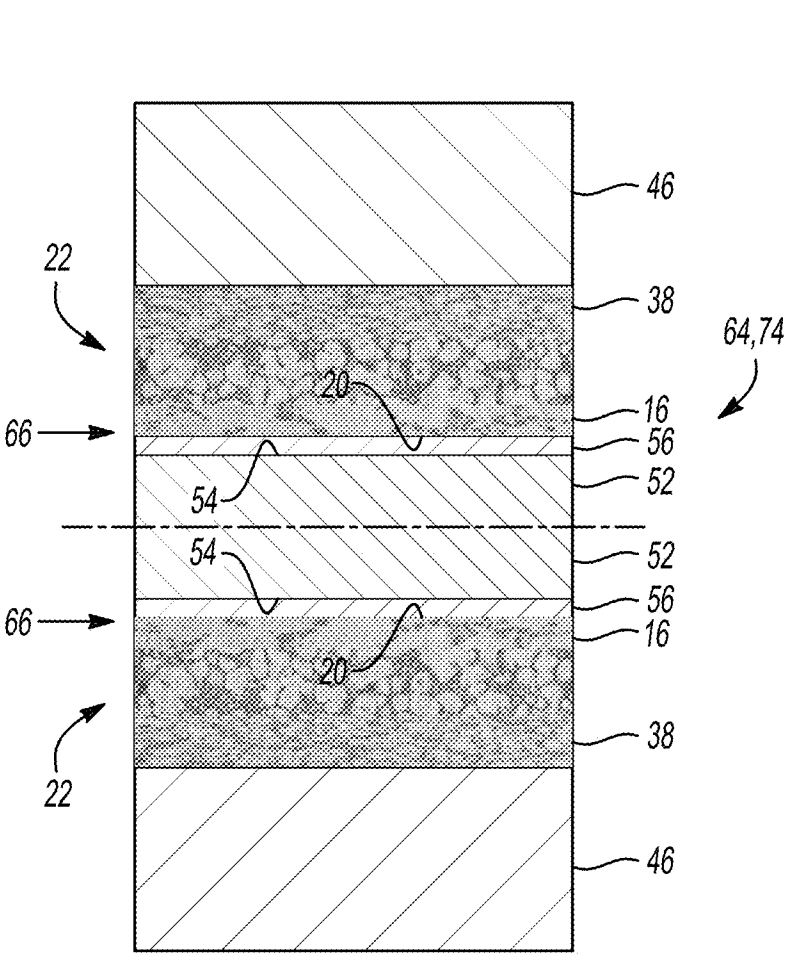
FIG. 5 is a schematic illustration of a cross-sectional view of another embodiment of the system of FIG. 2.

Referring to FIG. 5, in one embodiment, the core insert 52 may have an interface surface 54 facing the bore surface 20. That is, the interface surface 54 may be an external surface of the core insert 52. For this embodiment, the system 12 may further include a ceramic coating 56 disposed on the interface surface 54. That is, the ceramic coating 56 may be a thermal insulation coating that may function to reduce a localized solidification rate of the molten metal 50 (FIG. 3) during formation of the wear-resistant component 10. In particular, the ceramic coating 56 may contribute to formation of the first microstructure 24 adjacent the bore surface 20. The ceramic coating 56 may be characterized as a thermal barrier coating and may be applied to the interface surface 54 via, by way of non-limiting examples, a high velocity oxygen fuel flame spraying process, dip coating, rolling, spraying, baking, and the like. Suitable examples of the ceramic coating 56 may include, but are not limited to, aluminum oxide, zirconium oxide, chromium oxide, titania, yttria-stabilized zirconia, and combinations thereof.

Figure 2:
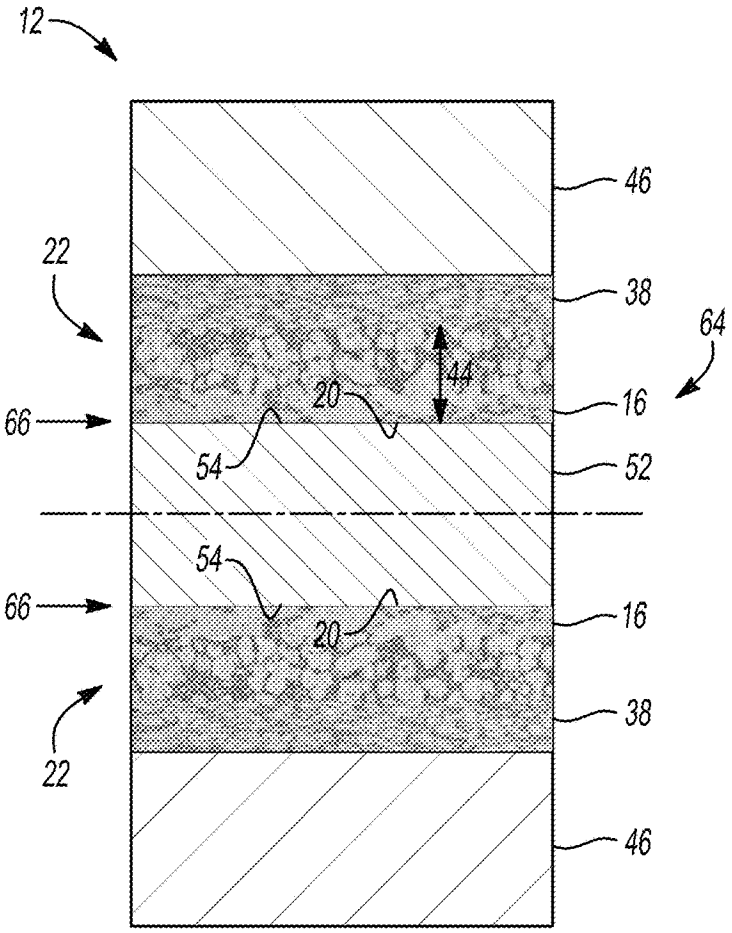
FIG. 2 is a schematic illustration of a cross-sectional view of a system including a die, the wear-resistant component of FIG. 1, and a core insert.

In another embodiment shown generally in FIG. 2, the core insert 52 may be formed from at least one of a salt, sand, and an inorganic binder. That is, the core insert 52 may formed from a hard, water-soluble material, which may contribute to ease of removal of the core insert 52 after solidification of the molten metal 50 to form the first region 16 and first microstructure 24. Suitable examples of salts may include ammonium salts including halides, carbonates, sulfates, and nitrates; alkali salts; alkaline earth metal salts; and combinations thereof. Alternatively, an inorganic binder may be combined with sand to produce the core insert 52.

Figure 6:
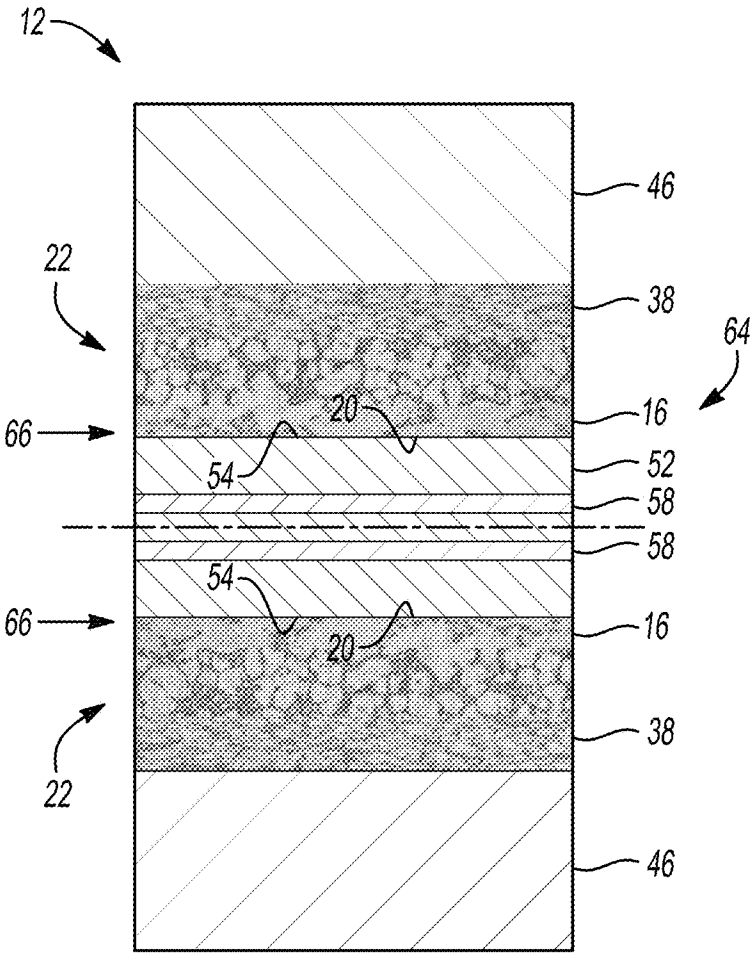
FIG. 6 is a schematic illustration of a cross-sectional view of an additional embodiment of the systems of FIGS. 2 and 5.

Referring now to FIG. 6, the core insert 52 may include a heating element 58 disposed beneath the interface surface 54. The heating element 58 may enable localized heating of the core insert 52 to thereby control the localized solidification rate of the molten metal 50 (FIG. 3) during formation of the wear-resistant component 10. For example, the heating element 58 may be disposed underneath the interface surface 54, i.e., within the core insert 52, and may include one or more of hot water conduits, oil conduits, electrical conduits configured for induction heating the core insert 52, and the like. The heating element 58 may have any configuration beneath the interface surface 54. For example, the heating element 58 may extend beneath the interface surface 54 along an entirety or along a portion of the interface surface 54. Alternatively, although not shown, the heating element 58 may be disposed on the interface surface 54. For example, the heating element 58 may be a reflector that may wrap around a portion or an entirety of the interface surface 54 to thereby warm the interface surface 54.

Figure 7:
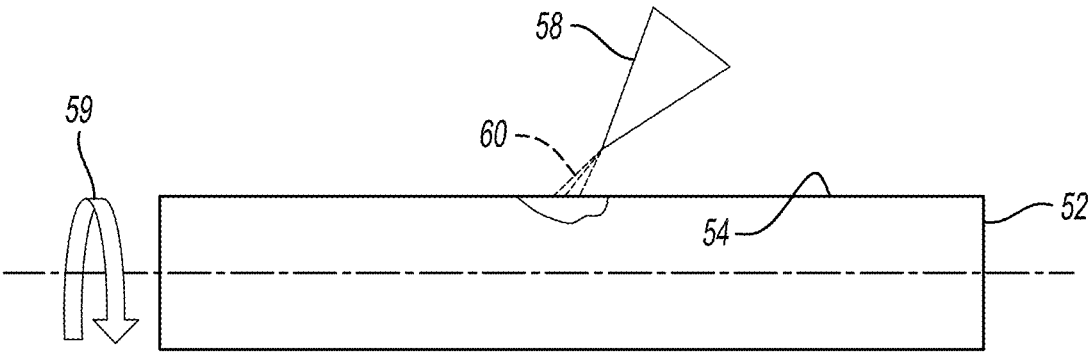
FIG. 7 is a schematic illustration of a side view of another embodiment of the core insert of FIG. 2.

In another non-limiting embodiment described with reference to FIG. 7, the heating element 58 may be a source 60 of thermal energy, e.g., an infrared thermal energy or a laser, configured to heat a portion or an entirety of the interface surface 54. For this embodiment, the source 60 of thermal energy may enable pinpoint or specific heating of the interface surface 54 to allow for localized solidification of the molten metal 50 at one or more particular locations along the bore surface 20. In one instance, the interface surface 54 may rotate about a longitudinal axis in a direction of arrow 59 to promote localized heating of the interface surface 54.

Figure 8:
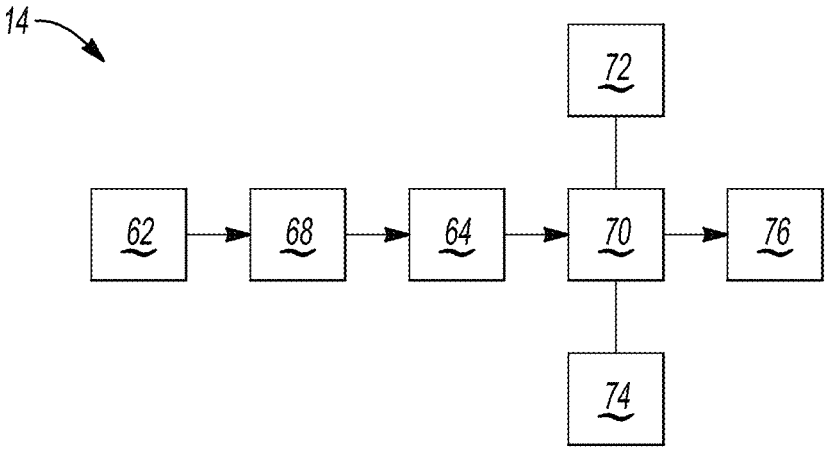
FIG. 8 is a schematic flowchart of a method of forming the wear-resistant component of FIG. 1.

Referring now to FIGS. 3 and 8, the method 14 of forming the wear-resistant component 10 includes disposing 62 the molten metal 50 (FIG. 3) into the cavity 48 (FIG. 3) defined by the die 46 (FIG. 3) at a pressure of from 10 MPa to 175 MPa. That is, the molten metal 50 may be injected into the cavity 48 at comparatively high pressure such that the method 14 may be characterized as a high pressure die casting process. The molten metal 50 may be disposed or deposited into the cavity 48 at a pressure of from 30 MPa to 160 MPa, or from 50 MPa to 140 MPa, or from 75 MPa to 125 MPa.

Referring now to FIGS. 2, 5, and 6, the method 14 also includes placing 64 the core insert 52 into the cavity 48 to form the bore surface 20 at an interface 66 of the molten metal 50 and the core insert 52. That is, the core insert 52 may be placed into the cavity 48 at a location at which the bore 18 is desired. For example, referring to FIG. 2, placing 64 the core insert 52 may include injecting a semi-solid paste formed from at least one of a salt, sand, and the inorganic binder into the cavity 48. That is, the semi-solid paste may include a solid fraction in an amount of about 50 parts by volume based on 100 parts by volume of the semi-solid paste. Further, the semi-solid paste may be injected into the cavity 48 at a temperature of from 600° C. to 700° C., e.g., about 650° C. Alternatively, referring to FIG. 6, placing 64 the core insert 52 may include situating the core insert 52 including the heating element 58 into the cavity 48. Further, referring to FIG. 5, the method 14 may further include, prior to placing 64, thermally spraying 68 (FIG. 8) the ceramic coating 56 onto the core insert 52. That is, placing 64 the core insert 52 may include situating the core insert 52 coated by the ceramic coating 56 into the cavity 48 (FIG. 3).

In addition, as described with continued reference to FIG. 8, the method 14 further includes solidifying 70 the molten metal 50 around the core insert 52. For example, the method 14 may include decreasing a temperature of the molten metal 50 to thereby solidify the molten metal 50. More specifically, the method 14 includes, concurrent to solidifying 70, cooling 72 the molten metal 50 at the bore surface 20 at a rate of from 0.01° C. per second to 1.5° C. per second to thereby form the substrate 22 having the first region 16 and the second region 38 as set forth above. That is, the method 14 may include, concurrent to solidifying 70, cooling 72 the molten metal 50 at the bore surface 20 at a rate of from 0.05° C. per second to 1° C. per second to thereby form the substrate 22. For example, the method 14 may include, concurrent to solidifying 70, cooling 72 the molten metal 50 at the bore surface 20 at a rate of less than 1° C. per second to thereby form the substrate 22 having the first region 16 having the first microstructure 24 adjacent the bore surface 20 and the first average particle size 26; and the second region 38 having the second microstructure 40 adjacent the first microstructure 24 and the second average particle size 42, such that the first average particle size 26 is larger than the second particle size 42. However, cooling 72 the molten metal 50 at the bore surface 20 at a rate of less than 0.01° C. per second or at a rate of greater than 1.5° C. per second may not form the desired first region 16 having the first microstructure 24. That is, cooling 72 the molten metal 50 at a faster rate or a slower rate than specified above may not impart wear-resistance to the wear-resistant component 10 at the first region 16.

More specifically, cooling 72 may include slowing the local solidification rate of the molten metal 50 within the first region 16. That is, cooling 72 may include reducing the local solidification rate from greater than 1.5° C. per second to less than or equal to 1° C. per second to form the first region 16. That is, cooling 72 may include forming the first region 16 such that the first microstructure 24 is characterized as coarse and includes the first number of grain boundaries 28. Similarly, cooling 72 may include forming the second region 38 such that the second microstructure 40 is characterized as fine and includes the second number of grain boundaries 128 that is greater than the first number of grain boundaries 28.

In one embodiment described with reference to FIG. 6, the method 14 may further include, concurrent to solidifying 70, warming 74 the core insert 52 at the heating element 58. That is, warming 74 may include conducting a thermally-conductive fluid, such as oil or water, through the heating element 58 to thereby controllably warm the core insert 52 and control the local solidification rate to less than or equal to 1° C. per second adjacent the interface surface 54. Such warming 74 may control the local solidification rate of the molten metal 50 at the bore surface 20 to thereby form the first region 16 having the first microstructure, which provides the bore surface 20 with excellent wear-resistance.

Alternatively, as described with reference to FIG. 7, the method 14 may further include, concurrent to solidifying 70, warming 74, i.e., at least one of induction heating, laser heating, and infrared heating, the core insert 52 on the interface surface 54. That is, the method 14 may include heating the interface surface 54 via induction heating, laser heating, infrared heating, and combinations thereof to thereby heat the core insert 52. Such heating may specifically control the local solidification rate of the molten metal 50 at the bore surface 20 to thereby form the first region 16 having the first microstructure, which provides the bore surface 20 with excellent wear-resistance.

The method 14 also includes, after cooling 72, removing 76 the core insert 52 from the substrate 22 to define the bore 18 and thereby form the wear-resistant component 10. In one example, the core insert 52 may taper along the interface surface 54 from one end to another, and removing 76 may include grasping or tapping the core insert 52 out of position to remove the core insert from the substrate 22. In another example, the core insert 52 may be formed from salt or a mixture of sand and an inorganic binder, and removing 76 may include dissolving the core insert 52 and flushing the core insert 52 out of the substrate 22 at the bore 18 with water or another fluid.

Therefore, the wear-resistant component 10, system 12, and method 14 provide excellent wear-resistance at a localized region, e.g., the first region 16. In particular, the first region 16 may provide excellent wear-resistance to wear induced by relative motion between components and may mitigate replacement of the wear-resistant component 10. Further, the core insert 52 and controlled localized cooling rate of from 0.01° C. per second to 1.5° C. per second, e.g., from 0.05° C. per second to 1° C. per second, during formation of the wear-resistant component 10 enables excellent longevity of the wear-resistant component and reduced replacement costs.

While the best modes for carrying out the disclosure have been described in detail, those familiar with the art to which this disclosure relates will recognize various alternative designs and embodiments for practicing the disclosure within the scope of the appended claims.

What is claimed is:

1. A wear-resistant component comprising:
- a substrate formed from a metal, defining a bore, and having a bore surface;
- wherein the metal is aluminum or an aluminum alloy selected from the group consisting of A380, A383, A360, ZA-8, ZA-12, and ZA-27;
- wherein the substrate includes:
  - a first region having a first microstructure and a first average particle size;
  - wherein the first microstructure includes a second phase of a plurality of particles formed from silicon that are dispersed within the metal; and
  - a second region having a second microstructure and a second average particle size; and
- wherein the first average particle size is larger than the second average particle size;
- wherein the first microstructure transitions to the second microstructure at a distance from the bore surface; and
- wherein the first microstructure is disposed between the bore surface and the second microstructure.

2. The wear-resistant component of claim 1, wherein the first region has a first wear-resistance and the second region has a second wear-resistance that is lower than the first wear-resistance.

3. The wear-resistant component of claim 1, wherein the first microstructure has a first number of grain boundaries, and further wherein the second microstructure has a second number of grain boundaries that is greater than the first number of grain boundaries.

4. The wear-resistant component of claim 1, wherein the second phase has a particle size of greater than 5 μm and less than or equal to 30 μm.

5. The wear-resistant component of claim 1, wherein the first microstructure has a dendritic arm spacing of greater than 40 μm and less than or equal to 100 μm.

6. The wear-resistant component of claim 5, wherein the second microstructure has a dendritic arm spacing of from 15 μm to 25 μm.

7. A system comprising:
- a die defining a cavity;
- a wear-resistant component including:
  - a substrate disposed within the cavity, formed from a metal, defining a bore, and having a bore surface;
  - wherein the metal is aluminum or an aluminum alloy selected from the group consisting of A380, A383, A360, ZA-8, ZA-12, and ZA-27;
  - wherein the substrate includes:
    - a first region having a first microstructure and a first average particle size;
    - wherein the first microstructure includes a second phase of a plurality of particles formed from silicon that are dispersed within the metal; and
    - a second region having a second microstructure and a second average particle size; and
- wherein the first average particle size is larger than the second average particle size;

wherein the first microstructure transitions to the second microstructure at a distance from the bore surface;

wherein the first microstructure is disposed between the bore surface and the second microstructure; and a core insert disposed within the bore.

8. The system of claim 7, wherein the core insert has an interface surface facing the bore surface and further including a ceramic coating disposed on the interface surface.

9. The system of claim 7, wherein the core insert is formed from at least one of a salt, sand, and an inorganic binder.

10. The system of claim 7, wherein the core insert has an interface surface facing the bore surface and includes a heating element disposed beneath the interface surface.

11. A method of forming a wear-resistant component, the method comprising:

disposing a molten metal into a cavity defined by a die at a pressure of from 10 MPa to 175 MPa;

wherein the molten metal is aluminum or an aluminum alloy selected from the group consisting of A380, A383, A360, ZA-8, ZA-12, and ZA-27;

placing a core insert into the cavity to form a bore surface at an interface of the molten metal and the core insert;

solidifying the molten metal around the core insert;

concurrent to solidifying, cooling the molten metal at the bore surface at a rate of from 0.01° C. per second to 1.5° C. per second to thereby form a substrate having:

a first region having a first microstructure and a first average particle size;

wherein the first microstructure includes a second phase of a plurality of particles formed from silicon that are dispersed within the metal; and a second region having a second microstructure and a second average particle size;

wherein the first average particle size is larger than the second average particle size;

wherein the first microstructure transitions to the second microstructure at a distance from the bore surface;

wherein the first microstructure is disposed between the bore surface and the second microstructure; and after cooling, removing the core insert from the substrate to define a bore and thereby form the wear-resistant component.

12. The method of claim 11, wherein cooling includes slowing a local solidification rate of the molten metal within the first region.

13. The method of claim 11, wherein cooling includes forming the first region such that the first microstructure includes a first number of grain boundaries, wherein the core insert has an interface surface facing the bore surface, and further wherein cooling includes forming the second region such that the second microstructure includes a second number of grain boundaries that is greater than the first number of grain boundaries.

14. The method of claim 11, further including, prior to placing, thermally spraying a ceramic coating onto the core insert.

15. The method of claim 11, wherein placing includes injecting a semi-solid paste formed from at least one of a salt, sand, and an inorganic binder into the cavity.

16. The method of claim 11, wherein the core insert has an interface surface facing the bore surface and includes a heating element disposed beneath the interface surface; and further including, concurrent to solidifying, warming the core insert at the heating element.

17. The method of claim 11, wherein the core insert has an interface surface facing the bore surface; and further including, concurrent to solidifying, at least one of induction heating, laser heating, and infrared heating the core insert on the interface surface.

* * * * *